US009169657B1

(12) United States Patent
Marek

(10) Patent No.: US 9,169,657 B1
(45) Date of Patent: Oct. 27, 2015

(54) MODULAR ATTIC FLOORING ASSEMBLY

(71) Applicant: Clyde Allen Marek, Rosenberg, TX (US)

(72) Inventor: Clyde Allen Marek, Rosenberg, TX (US)

( * ) Notice: Subject to any disclaimer, the term of this patent is extended or adjusted under 35 U.S.C. 154(b) by 0 days.

(21) Appl. No.: 14/337,132

(22) Filed: Jul. 21, 2014

(51) Int. Cl.
*E04F 11/16* (2006.01)
*E04F 15/02* (2006.01)

(52) U.S. Cl.
CPC ..... *E04F 15/02177* (2013.01); *E04F 15/02005* (2013.01); *E04F 2201/0138* (2013.01); *E04F 2201/02* (2013.01); *E04F 2203/00* (2013.01)

(58) Field of Classification Search
CPC ..... E04F 15/02177; E04F 15/02005; E04F 2203/00; E04F 2201/0138; E04F 2201/02
USPC ..... 52/177, 650.3, 660, 663, 664
See application file for complete search history.

(56) References Cited

U.S. PATENT DOCUMENTS 3,964,221 A * 6/1976 Berquist ..... 52/177
4,329,939 A * 5/1982 Christie et al. ..... 119/528
4,879,856 A * 11/1989 Jones et al. ..... 52/403.1
5,058,352 A * 10/1991 Loiselle et al. ..... 52/404.2
7,698,859 B2 * 4/2010 Sansano Marti ..... 52/177
8,015,761 B2 * 9/2011 Wainland ..... 52/177
8,266,849 B2 * 9/2012 Bravo et al. ..... 52/177
8,544,229 B2 * 10/2013 Kilgore et al. ..... 52/489.2
2005/0016098 A1 * 1/2005 Hahn ..... 52/384
2005/0028475 A1 * 2/2005 Barlow et al. ..... 52/578
2005/0284067 A1 * 12/2005 Mei ..... 52/480
2006/0032169 A1 * 2/2006 Mei ..... 52/392
2006/0185297 A1 * 8/2006 Mei ..... 52/506.05
2007/0094979 A1 * 5/2007 Richardson et al. ..... 52/578
2010/0162642 A1 7/2010 Allard

* cited by examiner

*Primary Examiner* — Brain Glessner
*Assistant Examiner* — Paola Agudelo
(74) *Attorney, Agent, or Firm* — Matthew Zarghouni; Fomby & Zarghouni LLC

(57) ABSTRACT

The present invention relates to a modular attic flooring assembly comprising a plurality of coupling panels for providing a surface, wherein each coupling panel of the plurality of coupling panels defined as having opposing ends, wherein each coupling panel comprising a surface extending between the opposing ends; a first end having a first mating member; a second end having a second mating member; at least two support legs symmetrically coupled below the surface; at least one indentation arranged on the lower portion of each support leg; wherein the at least one indentation of each support leg faces the at least one indentation of the other support leg, thereby forming a channel for receiving a joist below the surface; and wherein the first mating member of each coupling panel mating with the second mating member of an adjacent coupling panel.

10 Claims, 9 Drawing Sheets

MODULAR ATTIC FLOORING ASSEMBLY

FIELD OF THE INVENTION

The present invention pertains to a modular attic flooring assembly including a flooring component for developing a pathway in the attic.

BACKGROUND OF THE INVENTION

Installing a conventional floor or pathway in an attic is a complicated process requiring expertise and artisanship. Typical attic joists have drywalls attached to them to form a ceiling. Often the ceiling joists are horizontally oriented in longitudinal directions. Conventionally, the distance between joists has been 24 inches. In some homes, however, the distance is 16 inches. In addition, traversing the joists could be dangerous because they are not wide and drywall cannot bear the weight of a person.

Some attics however, have permanent pathways for a person to move around. For those attics without a permanent pathway, installing one is costly and labor intensive. Although, there have been some efforts to create temporary pathways for attics, none appears to be appropriate for everyday use. For instance, one method of creating a temporary pathway is laying down unsecured planks. Since they are unsecured, they could be very dangerous. In addition, these temporary pathways are too narrow.

Therefore, a need exists for a modular attic flooring which is stable, continuous, and wide enough for traversing. In addition, a need exists for a modular attic flooring capable of interlocking with various arrangements of the joists.

SUMMARY OF THE INVENTION

The present invention is about a modular attic flooring assembly, where it includes a plurality of coupling panels for providing a surface, wherein each coupling panel of the plurality of coupling panels defined as having opposing ends, wherein each coupling panel includes a surface extending between the opposing ends; a first end having a first mating member; a second end having a second mating member; at least two support legs symmetrically arranged below the surface, wherein each support leg having at least one indentation defined thereto, the at least one indentation arranged distal of the surface; wherein the at least one indentation of each support leg defining at least one horizontal channel below the surface in relation to the at least one indentation of the adjacent support leg; and wherein the first mating member of each coupling panel mating with the second mating member of an adjacent coupling panel. The first mating member forms a step adjacent to the lattice surface, wherein the first mating member extending across the first end and having at least one aperture.

The second mating member laterally extending adjacent to the surface in the plane of the surface, and the second mating member having at least one aperture defined thereto. The first mating member of each coupling panel positioned below the second mating member of the adjacent coupling panel forming a leveled surface of the two coupling panels. Furthermore, at least one aperture of the first mating member of each coupling panel positioned above the at least one aperture of the second mating member of the adjacent coupling panels whereby the two apertures forming a vertical channel through the first and the second mating members. In addition, the vertical channel receives a fastening member therein, wherein the fastening member joins the first mating member of each coupling panel with the second mating member of the adjacent coupling panel.

In addition, the at least one indentation receiving an adapter member, wherein the adapter member having a receiving end, wherein the receiving end configured to receive a side of a horizontally oriented joist extending in a longitudinal direction. In addition, the adapter member has a sliding end, wherein the sliding end slides into the at least one indentation, wherein the sliding end positioned adjacent to the receiving end. The at least one protrusion extending from the lower portion of the second mating member, at least one aperture defined in the first member, wherein the at least one aperture of the first mating member of each coupling panel receives the at least one protrusion of the second mating member of the adjacent coupling panel.

Besides, the at least one indentation is at least two placeholders arranged on each support leg of the at least two support legs, wherein each placeholder of the at least two placeholders is optionally breakable, thereby forming an indentation for receiving the side of the horizontally oriented joist extending in a longitudinal direction.

A modular attic flooring assembly comprising a plurality of coupling panels for providing a surface, wherein each coupling panel of the plurality of coupling panels defined as having opposing ends, wherein each coupling panel includes a lattice surface extending between the opposing ends; a first end having a first mating member, wherein the first mating member is a solid mating member; a second end having a second mating member, wherein the second mating member is a solid mating member; at least two support legs symmetrically arranged below the lattice surface, each leg of the at least two support legs having at least two adapter members, each adapter of at least two adapter members arranged distal of the lattice surface; wherein the space between the at least two adapter members is selectively variable; and wherein the first mating member of each coupling panel mating with the second mating member of an adjacent coupling panel.

The first mating member forms a step adjacent to the lattice surface, wherein the first mating member extending across the first end and having at least one aperture. Also, the second mating member extending across the second end in the plane of the lattice surface, wherein the second member having at least one protrusion member extending from the lower portion of the second mating member.

Furthermore, the at least one aperture of the first mating member of each coupling panel receives therein the at least one protrusion member of the adjacent coupling panel. The adapter member of the at least two adapter members having a receiving end for receiving a side of a horizontally oriented joist extending in a longitudinal direction. In addition, each adapter member of the at least two adapter members of each support leg having a sliding end, wherein the sliding end slides over a portion of the support leg.

The comprising a central support member positioned below the lattice surface between the at least two support legs, wherein the central support member extending for the majority of the lattice surface. The first mating member having at least one aperture, the second mating member having at least a second aperture, wherein the at least first aperture of each coupling panel corresponds to the at least second aperture of the adjacent coupling panel thereby forming a vertical channel, wherein a fastening member passing through the vertical channel. The at least two support legs are rigid support legs. Also, each adapter member of the at least two adapter members is an optionally breakable indentation for forming an indentation for receiving the side of the horizontally oriented joist extending in a longitudinal direction.

DESCRIPTION OF THE EMBODIMENTS

Figure 1:
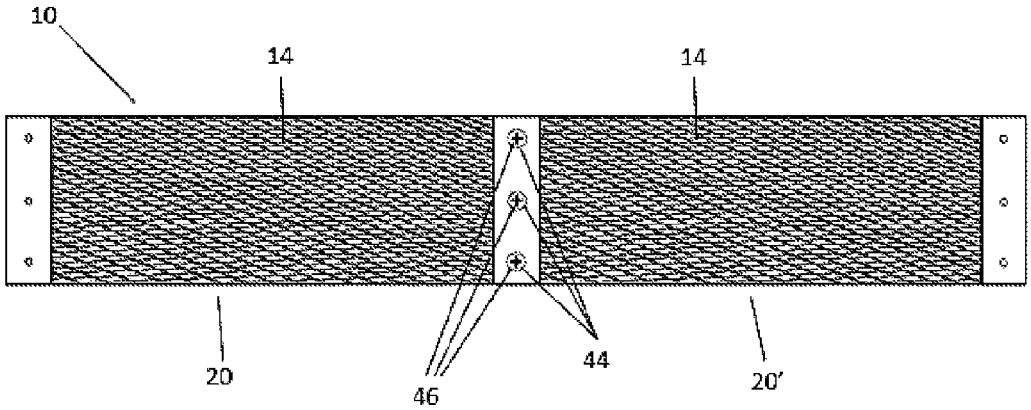
FIG. 1 illustrates a top view of a modular attic flooring assembly.
Figure 2:
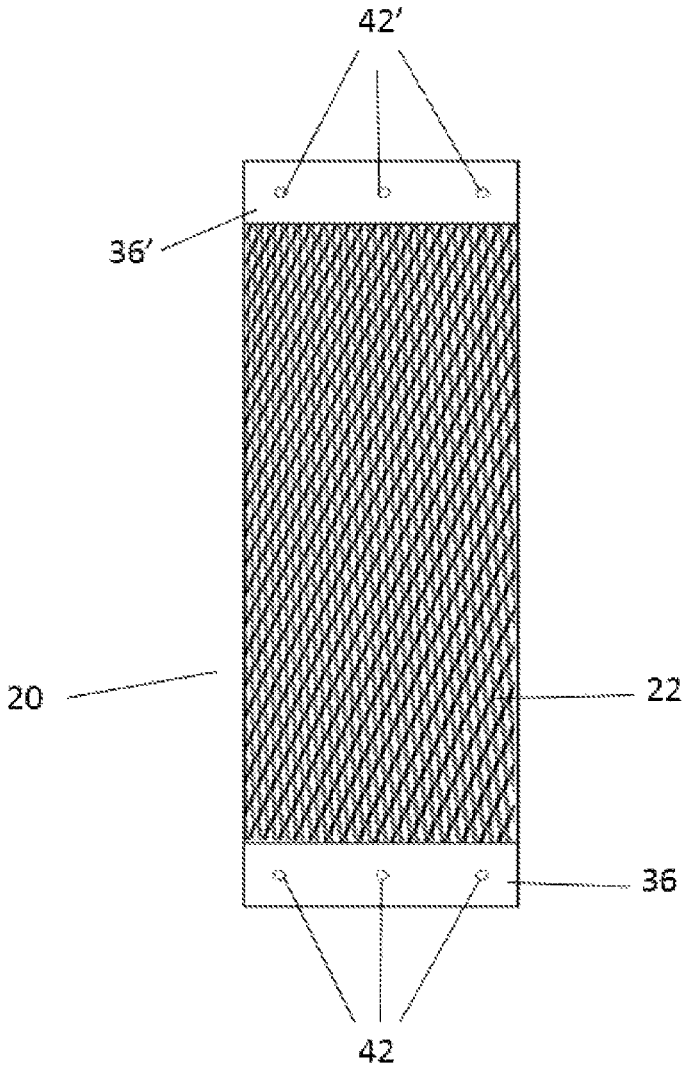
FIG. 2 illustrates a top view of a coupling panel.
Figure 3:
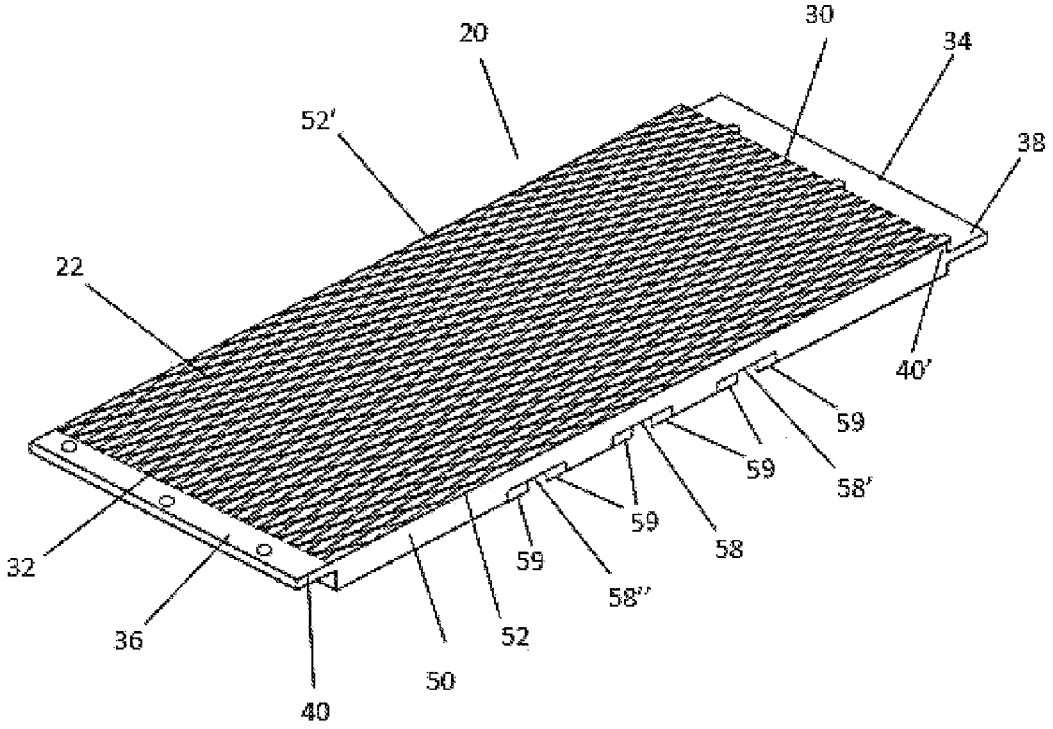
FIG. 3 illustrates a perspective view of the coupling panel.

Although the invention will be described in connection with certain aspects and/or embodiments, it will be understood that the invention is not limited to those particular aspects and/or embodiments. On the contrary, the invention is intended to cover all alternatives, modifications, and equivalent arrangements as may be included within the spirit and scope of the invention as defined by this description.

Referring to FIGS. 1-4, they illustrate a modular attic flooring assembly 10. The modular attic flooring assembly 10 provides a pathway 14. The pathway 14 may be an even surface. Furthermore, the modular attic flooring assembly 10 is configured to interlock with the joists (not shown) to prevent the modular attic flooring assembly 10 from sliding.

The modular attic flooring assembly 10 comprises a plurality of coupling panels 20. Each coupling panel may be made of plastic, metal, wood, fiberglass, or a combination thereof. In order to create a pathway, each coupling panel 20 of the modular attic flooring assembly includes a surface 22. The surface 22 may be solid, mesh, lattice or a combination thereof. The coupling panels 20 are rectangular coupling panels, however, square shaped coupling panels may be used.

Each coupling panel 20 also includes a first end 30 and a second end 32. The first end 30 and the second end 32 are two opposite ends of each coupling panel 20. A first mating member 34 positioned adjacent to the first end 30. The first mating member 34 is a lateral step extending for the length of the first end 30. In some embodiments, the first mating member 34 may be a plurality of extension ledges positioned adjacent to first end 30, or the first mating member 34 may be a number of protrusions members extending outwardly from the first end 30. The first mating member 34 coupled to the first end 30. In some embodiments, the first end 30 and the first mating member 34 are integral.

A second mating member 36 extends along the second end 32. The second mating member 36 is a lateral ledge, which extends for the length of the second end 32 in the same plane as the surface 22. In some embodiments, the second mating member 36 may be a plurality of extension ledges positioned adjacent to the second end 32 or a number of horizontal apertures (not shown) defined into the second end 32. Note that those arrangements are required since the first mating member 34 of each coupling panel 20 mates with the second mating member 36 of an adjacent coupling panel 20'. For instance, in some embodiments, the extension ledges of the first mating member of each coupling panel interlock with the extension ledges of the second mating member of the adjacent coupling panel. Further, in other embodiments of the present invention, the horizontal apertures defined in the first end of each coupling panel receive the protrusion members of the second end of the adjacent coupling panel.

In the present embodiment, two coupling panels 20, 20' connect when the first mating member 34 of each coupling panel 20 is set below the second mating member 36 of the adjacent coupling panel 20'. The depth of the step 40 provided by the first mating member 34 corresponds to the thickness 40' of the second mating member, so when the second mating member 36 rests on the first mating member 34, an even surface is created. The first and second mating members 34, 36 include a plurality of apertures 42, 42'. For instance, the first and second mating members 34, 36 each include three apertures 42, 42'. Nevertheless, more or less apertures may be included. Further, when the first mating member and the second mating member are mating, the apertures align, thereby forming vertical channels 44, which extend into the first and the second mating members. Each vertical channel 44 receives a fastening member 46 to connect the first mating member 34 to the second mating member 36.

Figure 6:
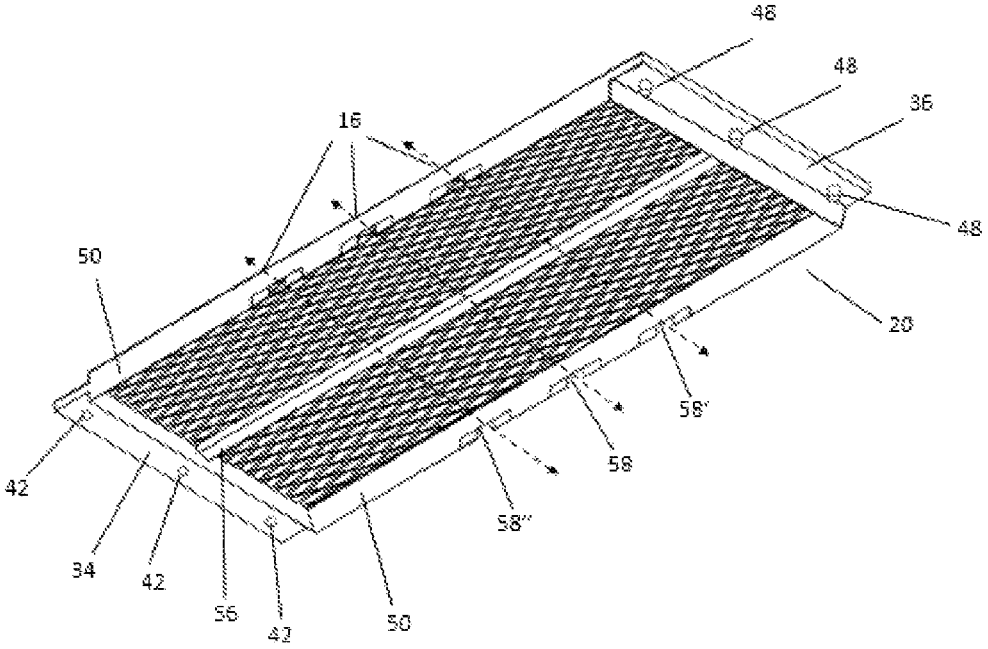
FIG. 6 illustrates a perspective view of the bottom of another embodiment of the coupling panel.
Figure 7:
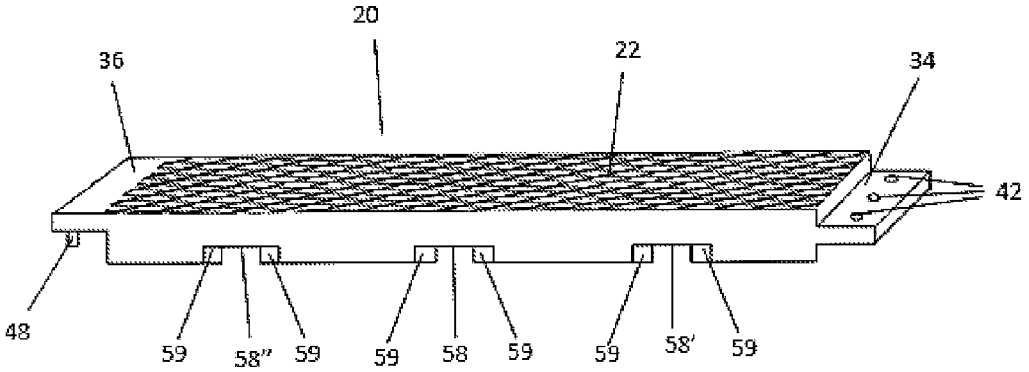
FIG. 7 illustrates a perspective view of the side of another embodiment of the coupling panel.
Figure 8:
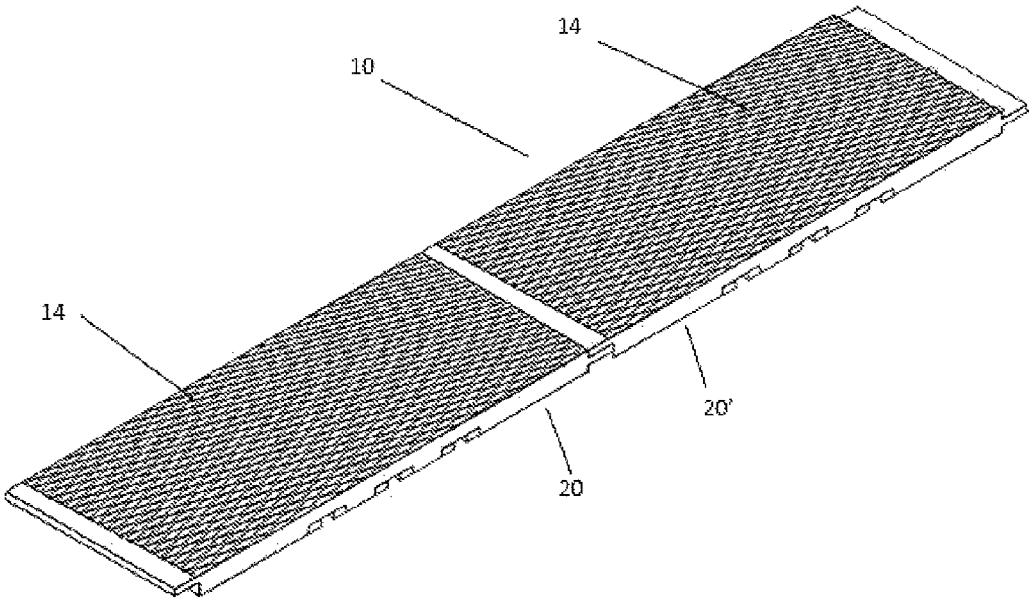
FIG. 8 illustrates a perspective view of an embodiment of the modular attic flooring assembly.

In the embodiment of FIGS. 6-8, instead of the plurality of apertures 42', the second mating member 36 includes a plurality of protrusions 48. The plurality of protrusions 48 extend from the lower side of the second mating member 36. The plurality of protrusions 48 correspond to the plurality of apertures 42 of the first mating member 34. Each aperture of the plurality of apertures 42 of the first mating members receives one protrusion of the plurality protrusions 48 therein, thereby interlocking each coupling panel 20 to the adjacent coupling panel 20'.

For instance, each protrusion 48 is a spacer pin attached to the lower side of the second mating member 36. In some embodiments, the protrusions 48' attached to the upper side of the first mating member 34, and the first mating member 32 includes an aperture 42 on its lower side. In another embodiment, each of the first mating member and second mating member include both protrusions and apertures, which correspond together.

Referring now to FIGS. 1-8, each coupling panel 20 further includes at least two support legs 50. The two support legs 50 arranged below the edges 52, 52' of the surface 22. The at least two support legs 50 extend for the majority of the surface 22. The at least two support legs 50 are symmetrically arranged, such that each support leg 50 is positioned at an equal distance from the center of each coupling panel 20. The at least two support legs 50 are solid legs. For example, the support legs may be made of metallic, wooden, plastic or a combination thereof.

Each support leg 50 has at least one indentation. In the present invention, each support leg 50 has at least three indentations 58, 58', 58". Two side indentations 58', 58" configured on the sides of a central indentation 58. All of these indentations 58, 58', and 58"arranged distal of the surface 22. Note that the placement of the indentations on each support legs 50 corresponds to the placement of the ceiling joists. For example, the center indentation 58 is placed 24' from each end 30, 32, and the length between the two side indentations 58', 58" is 16 inches. Likewise, the distance between each end 30, 32 of the coupling panel 20 and the adjacent side indentation 58', 58" is 16 inches.

Each indentation may include at least one breakable placeholder 59. The size of each indentation, 58, 58', 58" expands by breaking each breakable placeholder 59. Each indentation may include two breakable placeholders 59 for use in connection with thicker joists.

Figure 4:
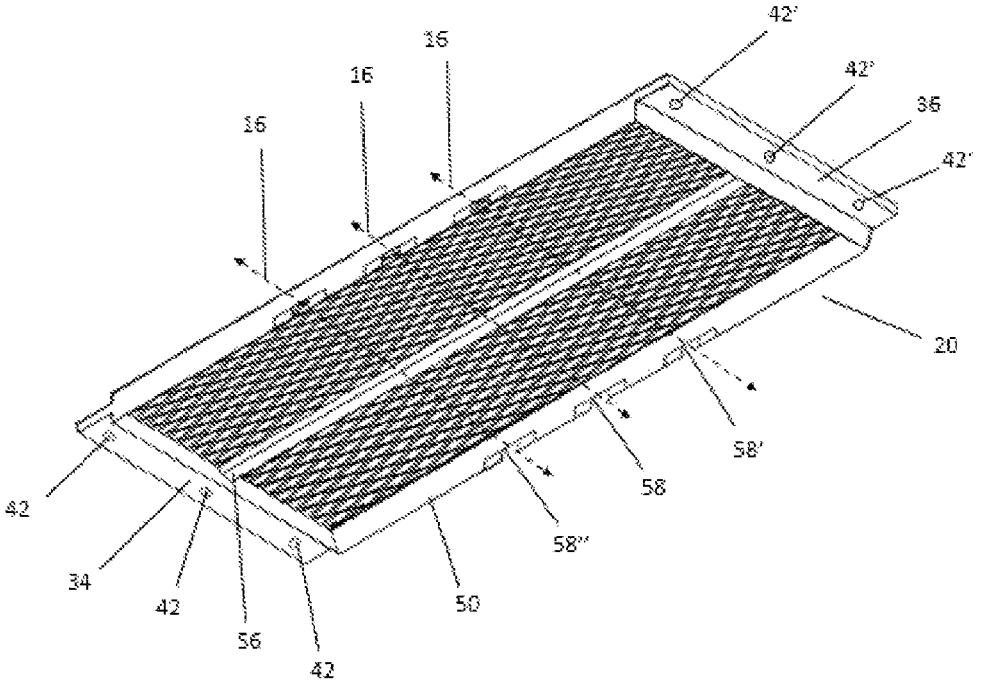
FIG. 4 illustrates a perspective view of the bottom of the coupling panel.
Figure 5:
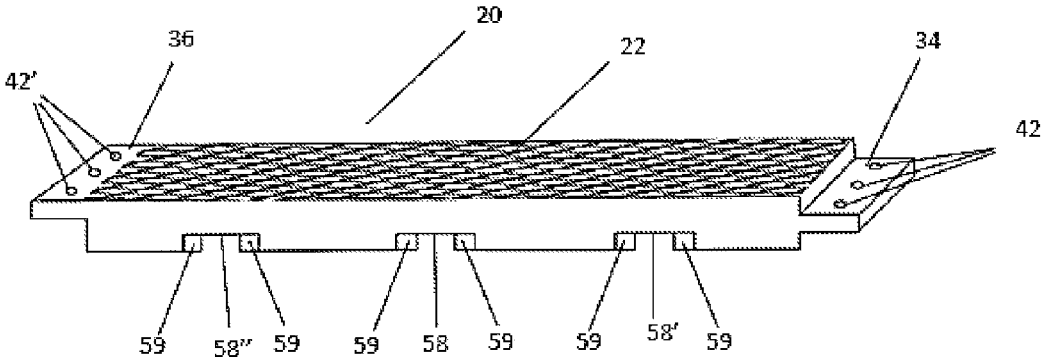
FIG. 5 illustrates a perspective view of the side of the coupling panel.

Referring to FIGS. 4 and 6, the indentations 58, 58', 58" of the two support legs 50 define three horizontal channels 16 below each coupling panel 20. That is because the indentations arranged identically on each support leg. Each horizontal channel 14 receives a ceiling joist, thereby preventing the coupling panel 20 from sliding on the joists. Furthermore, the first and the second mating members 34, 36 may be arranged so a joist may be placed under them when mating.

In some embodiments, each support leg 50 includes placeholders (not shown) instead of the indentations. Each placeholder is detachable to make an indentation. Further, each support leg 50 may include at least two placeholders, where the placeholders' arrangements accord to the placements of the joists. The placeholders' placements have to match the placement of the joists for the coupling panel 20 to interface with the joists; otherwise, the coupling panel 20 will slide on the joists.

In the present invention, each coupling panel 20 includes a central support member 56 that is positioned below the surface 22 and between the at least two support legs 56. The central support member 56 extends below the surface 22 and gives it an additional support from beneath.

Figure 9:
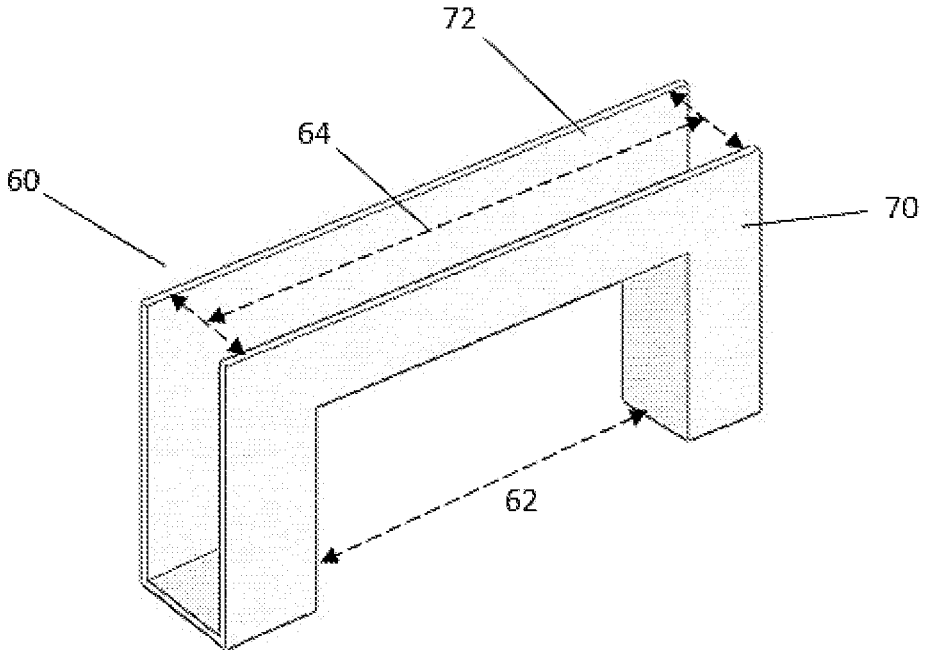
FIG. 9 illustrates a perspective view of an adapter member.

Referring now to FIG. 9, each indentation 58, 58', 58" may receive an adapter member 60. The adapter member 60 shaped to form a bracket. The adapter member 60 has a receiving end 62 and a sliding end 64. The receiving end 62 receives the ceiling joist. The sliding end 64 of the adapter member may slide onto each indentation 58, 58', and 58". In some embodiment, the receiving end 62 is selectively adjustable corresponding to the thickness of a joist. For example, the receiving end may include a gripping device for adjustment.

For example, the sliding end 64 of the adapter member 60 slides onto the indentation 58, from the sliding end 64. The sliding end 64 shaped to slide onto the indentations. For example, the receiving end may be an inverted square bracket to correspond to the interior side of each indentation. Furthermore, in order to securely hold the adapter member on each indentation 58, 58', 58", the sliding end 64 includes two ledges 70, 72 that slide over each indentation and firmly engage the sides of each indentation.

Furthermore, each support leg 56 may include more than one adapter 60, wherein each support leg 50 receives the adapters 60 at two or more indentations. This arrangement permits a user to selectively position the adapters on the indentations of each support leg 50. In some embodiments, each support leg 50 may include a large indentation, the indentation may have a ledge where the at least two adapter members will be configured to slide along the ledge. This arrangement will allow the adapter members to be adjustable with respect to the ceiling joists. Each adapter member may also have a locking mechanism, such as a lever, to lock to the ledge.

As is evident from the foregoing description, certain aspects of the present invention are unlimited by the particular details of the examples illustrated herein, and it is therefore contemplated that other modifications and applications, or equivalents thereof, will occur to those skilled in the art. It is accordingly intended that the claims shall cover all such modifications and applications that do not depart from the spirit and scope of the present invention.

The invention claimed is:

1. A modular attic flooring assembly comprising:

a plurality of coupling panels for providing a surface, wherein each coupling panel of the plurality of coupling panels defined as having opposing ends, wherein each coupling panel comprising:

a lattice surface extending between the opposing ends;

a first end having a first mating member, wherein the first mating member is a solid mating member;

a second end having a second mating member, wherein the second mating member is a solid mating member;

at least two support legs symmetrically coupled below the lattice surface, each leg of the at least two support legs having at least two adapter members;

wherein the space between the at least two adapter members is selectively variable; and wherein the first mating member of each coupling panel mating with the second mating member of an adjacent coupling panel.

2. The modular attic flooring assembly of claim 1, wherein the first mating member forming a step adjacent to the lattice surface, wherein the first mating member extending across the first end and having at least one aperture.

3. The modular attic flooring assembly of claim 2, wherein the second mating member extending across the second end in the plane of the lattice surface, wherein the second member having at least one protrusion member extending from the lower portion of the second mating member, and wherein the second end having a thickness corresponding to the step of the first mating member.

4. The modular attic flooring assembly of claim 3, wherein the at least one aperture of the first mating member of each coupling panel receives therein the at least one protrusion member of the second mating member of the adjacent coupling panel.

5. The modular attic flooring assembly of claim 1, wherein each adapter member of the at least two adapter members having a receiving end for receiving a side of a horizontally oriented joist extending in a longitudinal direction.

6. The modular attic flooring assembly of claim 1, wherein each adapter member of the at least two adapter members of each support leg having a sliding end, wherein the sliding end slides over a portion of the support leg.

7. The modular attic flooring assembly of claim 1, further comprising a central support member positioned below the lattice surface between the at least two support legs, wherein the central support member extending for the majority of the lattice surface.

8. The modular attic flooring assembly of claim 1, further comprising the first mating member having at least one aperture, the second mating member having at least one aperture, wherein the at least one aperture of each coupling panel corresponds to the at least one aperture of the adjacent coupling panel thereby forming a vertical channel, and wherein a fastening member passing through the vertical channel.

9. The modular attic flooring assembly of claim 1, wherein the at least two support legs are solid support legs.

10. The modular attic flooring assembly of claim 1, wherein each adapter member of the at least two adapter members is an optionally breakable placeholder for forming an indentation for receiving the side of the horizontally oriented joist extending in a longitudinal direction.

* * * * *